US009607532B2

(12) United States Patent
Gibson et al.

(10) Patent No.: US 9,607,532 B2
(45) Date of Patent: Mar. 28, 2017

(54) MOVABLE SIGNAGE APPARATUS AND METHOD

(71) Applicants: James Gibson, Lander, WY (US); Wendy Gibson, Lander, WY (US)

(72) Inventors: James Gibson, Lander, WY (US); Wendy Gibson, Lander, WY (US)

( * ) Notice: Subject to any disclaimer, the term of this patent is extended or adjusted under 35 U.S.C. 154(b) by 0 days.

(21) Appl. No.: 14/158,623

(22) Filed: Jan. 17, 2014

(65) Prior Publication Data

US 2014/0196334 A1 Jul. 17, 2014

Related U.S. Application Data

(60) Provisional application No. 61/753,701, filed on Jan. 17, 2013.

(51) Int. Cl.

| | |
|---|---|
| ***G09F 7/00*** | (2006.01) |
| ***G09F 7/22*** | (2006.01) |
| ***G09F 15/00*** | (2006.01) |

(52) U.S. Cl.

CPC ..... *G09F 7/22* (2013.01); *G09F 15/0037* (2013.01); *G09F 15/0087* (2013.01)

(58) Field of Classification Search

CPC ..... G09F 11/23; G09F 11/232; G09F 11/235; G09F 11/04

USPC ..... 40/473, 474, 495, 606.14, 606.15, 624, 40/607.1–607.12, 484; 248/122.1, 126, 248/291.1

See application file for complete search history.

(56) References Cited

U.S. PATENT DOCUMENTS

| | | | | | |
|---|---|---|---|---|---|
| 470,034 | A | * | 3/1892 | Belknap | 40/470 |
| 2,091,392 | A | * | 8/1937 | Linstrom | 40/474 |
| 2,319,046 | A | * | 5/1943 | Druce | 352/102 |
| 2,528,962 | A | * | 11/1950 | Lieutard | 116/63 P |
| 2,939,330 | A | * | 6/1960 | Margetts | 74/411 |
| 3,213,557 | A | * | 10/1965 | Clement | 40/614 |
| 4,225,105 | A | | 9/1980 | Nakamura | |
| 4,627,182 | A | | 12/1986 | Weiss | |
| 5,694,733 | A | | 12/1997 | Gallemore, II | |

(Continued)

FOREIGN PATENT DOCUMENTS

| | | |
|---|---|---|
| CA | 1259191 | 9/1989 |
| CN | 2422708 | 3/2011 |

(Continued)

*Primary Examiner* — Cassandra Davis
(74) *Attorney, Agent, or Firm* — Kunzler Law Group

(57) ABSTRACT

The present disclosure relates to a system that includes a support member and a sign supported by the support member. The sign may have a generally planar shape and may extend in a plane. The system also includes a repositioning mechanism coupled to the sign and the support member. The repositioning mechanism rotates the sign substantially in-plane. The system may further include a controller for controlling rotation of the sign. In one implementation, the repositioning mechanism is retrofitted on an existing sign and an existing support member. The repositioning mechanism may include a power source attached to the support member that provides power to the repositioning mechanism. The repositioning mechanism may further include a linkage attached to the sign and a transmission for transferring rotational power to the sign, wherein the transmission is interconnected between the power source and the linkage.

3 Claims, 6 Drawing Sheets

(56) References Cited

U.S. PATENT DOCUMENTS

| | | | | |
|---|---|---|---|---|
| 6,282,823 | B1 * | 9/2001 | Brown | 40/593 |
| 6,561,750 | B1 | 5/2003 | Musselman et al. | |
| 6,889,952 | B2 * | 5/2005 | Cook et al. | 248/458 |
| 7,264,434 | B2 | 9/2007 | Kozak | |
| 7,490,807 | B2 | 2/2009 | Souza et al. | |
| 7,736,116 | B2 | 6/2010 | Kozak | |
| 2005/0173601 | A1 | 8/2005 | Hestand | |
| 2009/0278006 | A1 | 11/2009 | Park et al. | |
| 2009/0314912 | A1 * | 12/2009 | Whitley et al. | 248/299.1 |
| 2011/0239500 | A1 | 10/2011 | Gatuslao | |
| 2012/0017477 | A1 | 1/2012 | Sipperley et al. | |
| 2013/0185967 | A1 * | 7/2013 | Adams et al. | 40/218 |

FOREIGN PATENT DOCUMENTS

| | | |
|---|---|---|
| KR | 20020078163 | 10/2002 |
| KR | 20030043803 | 6/2003 |

* cited by examiner

MOVABLE SIGNAGE APPARATUS AND METHOD

FIELD

This invention relates to display signs and more particularly relates to rotating signs to draw the attention of passersby.

BACKGROUND

Billboards are a common sight, particularly along well-used thoroughfares and busy urban areas. Accordingly, it is easy for a billboard to be lost among the rest, or to lose mental relevance as people pass the same billboard over and over again. In either case, the billboard's message often does not reach the desired audience.

It would be an advantage in the art to provide a billboard that changes visibly from one viewing to the next so as to distinguish itself from other billboards and garner attention. It would further be advantageous for such a billboard to be simple and inexpensive to construct. It would be further advantageous for such a billboard to be easily maintained and serviced.

SUMMARY

The subject matter of the present application has been developed in response to the present state of the art, and in particular, in response to the problems and needs in the art that have not yet been fully solved by currently available exhaust aftertreatment systems. Accordingly, the subject matter of the present application has been developed to provide signage apparatus, methods, and systems that overcome at least some shortcomings of the prior art.

The present disclosure relates to a system that includes a support member and a sign supported by the support member. The sign may have a generally planar shape and may extend in a plane. The system also includes a repositioning mechanism coupled to the sign and the support member. The repositioning mechanism rotates the sign substantially in-plane. The system may further include a controller for controlling rotation of the sign. In one implementation, the repositioning mechanism is retrofitted on an existing sign and an existing support member.

The repositioning mechanism may include a power source attached to the support member that provides power to the repositioning mechanism. The repositioning mechanism may further include a linkage attached to the sign and a transmission for transferring rotational power to the sign, wherein the transmission is interconnected between the power source and the linkage. In one embodiment, the sign is rotatable in a substantially continuous motion. In yet another embodiment, the sign is rotatable in a substantially discontinuous motion. In one implementation, the sign is rotatable 360 degrees in-plane and in another implementation the sign is rotatable back and forth between predetermined angled position limits.

The present disclosure also relates to a method that includes providing a support member and supporting a sign on the support member. The sign may have a generally planar shape and may extend in a plane. The method further includes rotating the sign substantially in-plane. In one embodiment, rotating the sign is a substantially continuous motion while in another embodiment the motion is discontinuous. Further, the sign may rotate 360 degrees in-plane and/or the sign may rotate back and forth between predetermined angled position limits. The sign may be configured to rotate at a rate that captures attention of passersby while still allowing the passersby to perceive the message on the sign.

The present disclosure also relates to a sign repositioning apparatus that includes a power source, attachable to a support member, for providing power to the apparatus. The apparatus also includes a linkage attachable to a sign and a transmission for transferring rotational power to the sign, wherein the transmission is interconnected between the power source and the linkage. The apparatus may further include a disconnect mechanism for disconnecting the transmission from one or more of the power source and the linkage. Also, the apparatus may further include a disconnect mechanism for disconnecting the linkage from one or more of the transmission and the sign. In on implementation, the apparatus includes a brake mechanism for securing the sign in a specific position. The transmission, according to one embodiment, may include a pinion and gear assembly that is retrofittable on an existing support member and sign.

Reference throughout this specification to features, advantages, or similar language does not imply that all of the features and advantages that may be realized with the subject matter of the present disclosure should be or are in any single embodiment. Rather, language referring to the features and advantages is understood to mean that a specific feature, advantage, or characteristic described in connection with an embodiment is included in at least one embodiment of the present disclosure. Thus, discussion of the features and advantages, and similar language, throughout this specification may, but do not necessarily, refer to the same embodiment.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

Figure 1:
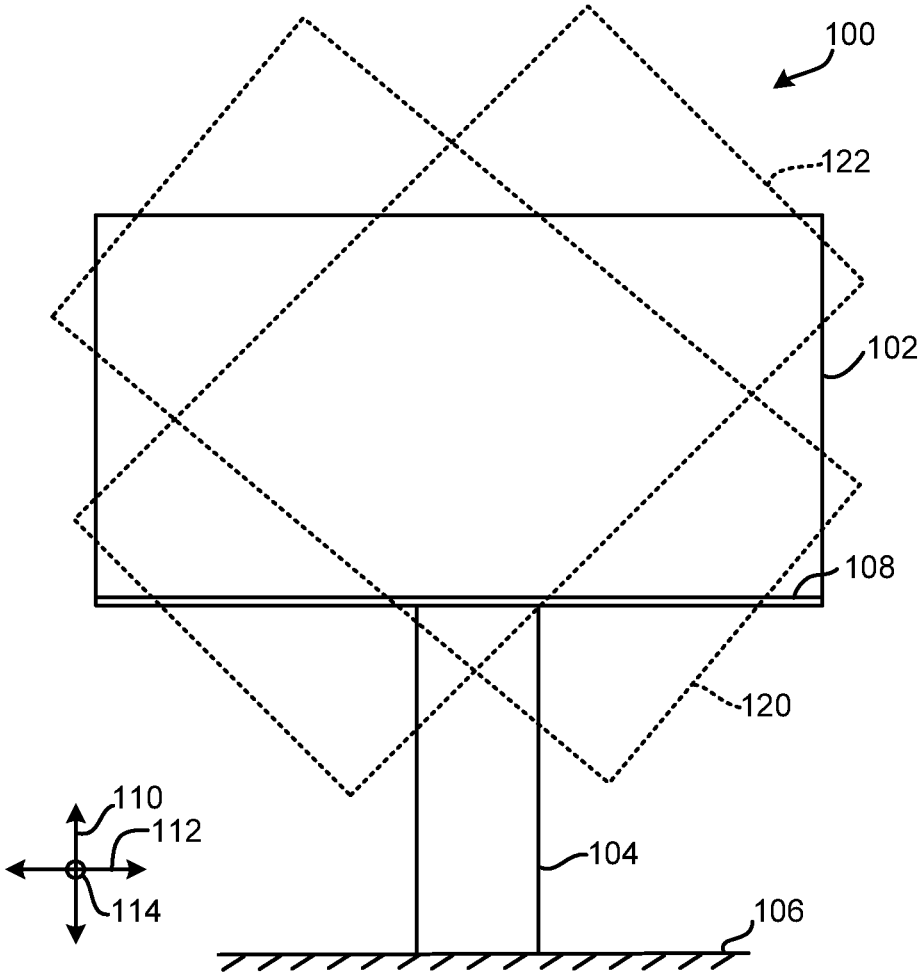
FIG. 1 is a front elevation view of an apparatus according to one embodiment of the invention.

FIG. 1 is a front elevation view of an apparatus 100 according to one embodiment of the invention. The apparatus 100 may take the form of a billboard 100. As shown, the billboard 100 includes a sign 102 supported by a support member 104 at an elevation over a supporting surface 106 such as the ground or the roof of a building. The sign 102 may be an advertisement or may provide other types of messaging such as public service announcements and the like. The billboard 100 may have a walkway 108 that can support a person to facilitate servicing of the sign 102 to make repairs, change the advertisement, or perform other needed functions.

In the following description, directions will be provided with reference to the arrows 110, 112, 114. The arrow 110 illustrates the vertical direction, the arrow 112 illustrates the lateral direction, and the arrow 114 (pointing into and out of the viewing plane, e.g., into and out of the page) illustrates the transverse direction.

The billboard 100 may be designed to permit and/or carry out rotation of the sign 102 relative to the supporting surface 106 and the support member 104. This rotation may occur in-plane, i.e., so that the sign 102 remains substantially within the same plane. Thus, rotation occurs about the transverse direction 114. FIG. 1 illustrates a clockwise rotated position 120 and a counterclockwise rotated position 122.

In this application, "in-plane" may be used for any object that is generally planar in shape. An object that has some deviations from a planar shape can still rotate "in-plane" as long as the object has one dimension (such as the thickness of the sign 102 in the transverse dimension 114) that is relatively small compared to its other two orthogonal dimensions. Thus, if the sign 102 had bumps, features, a modest concavity or convexity, or other departures from the plane defined by the vertical and lateral directions 110, 112, it could still rotate "in-plane" by rotating about the transverse axis 114.

Rotation of the sign 102 may make it more noticeable for a variety of reasons. If the motion is rapid enough to be noticed within the time it is visible to the viewer, the motion itself will draw attention because the human eye is naturally drawn to motion. Whether or not the motion of the sign 102 is perceptibly fast, a viewer may pay attention to the sign 102 simply because it is oriented at an angle other than the horizontal orientation that is customary for billboards. Further, if the orientation of the sign 102 changes between viewings, the sign will attract notice because the viewer will likely recognize that motion has occurred.

Rotation of the sign 102 may be carried out in a wide variety of ways. If desired, the maximum clockwise and maximum counterclockwise angulations may be quite extreme (positioning the sign 102 vertical or even upside-down). The sign 102 may rotate full circle, if desired, so that there is no maximum clockwise or counterclockwise angulation. However, it may be desirable to limit motion of the sign to angles that will keep the sign 102 at readable orientations. According to one example, the sign 102 rotates from the horizontal position shown in FIG. 1, clockwise along an arc spanning 60°, to reach its maximum clockwise angulation. Then, the sign 102 may rotate counterclockwise along an arc spanning 120° to reach its maximum counterclockwise angulation. From there, the sign 102 may again rotate clockwise along an arc spanning 60° to reach the horizontal position. Alternatively, the maximum clockwise and counterclockwise angulations (hereinafter referred to as "terminal orientations") may be displaced from the horizontal orientation by 45°, 30°, 15°, or any other angle.

Motion of the sign 102 may be continuous or intermittent (i.e., the sign 102 may remain continuously in motion between its terminal orientations or may stop at any angle for a period of time before continuing to move. Further, the motion of the sign may be fast or slow. For example, the sign 102 may move through a full cycle of motion (i.e., from the horizontal orientation, through both terminal orientations, and back to the horizontal orientation, in a few seconds, such as five, ten, fifteen, twenty, thirty, or forty-five seconds. Such motion may be perceived by the viewer.

Alternatively, the sign 102 may move more slowly, and may take a matter of minutes to complete a full motion cycle. For example, the sign 102 may take one, two, three, five, ten, fifteen, twenty, thirty, or forty-five minutes to complete the motion cycle. Such motion will likely not be visually perceptible with the level of attention most people give to billboards, but will likely result in the sign 102 being oriented differently when the viewer returns and looks at the sign 102 again.

As another alternative, the sign 102 may move more slowly still. For example, the sign 102 may take one, two, three, six, twelve, or eighteen hours to complete a full motion cycle. If desired, the sign 102 may even take one, two, three, five, ten, fifteen, twenty, or thirty days to complete the full motion cycle. Such slow motion may advantageously consume less power, while still possibly positioning the sign 102 at a perceptibly different orientation between viewings.

In FIG. 1, the support member 104 takes the form of a single post 104. However, the present invention may be utilized with a wide variety of support members, including two or more vertical posts, vertical surfaces such as walls, or the like. The sign 102 may have a wide variety of shapes and sizes. The sign 102 need not be rectangular, but may be circular, elliptical, or otherwise shaped to properly present the desired message. According to one embodiment, the sign 102 may be about fourteen feet tall and forty-eight feet wide, for a total surface area of 672 square feet.

Figure 2:
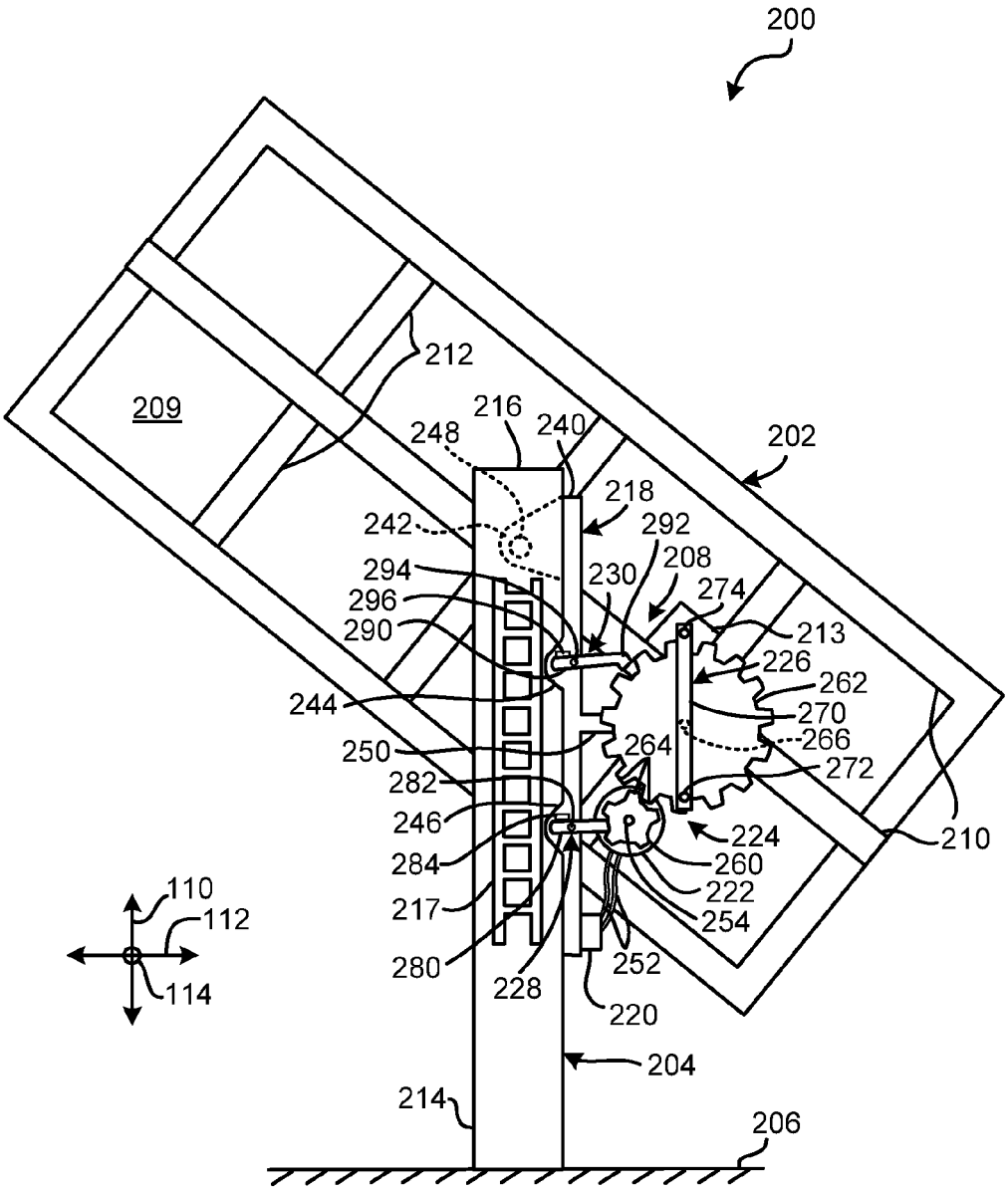
FIG. 2 is a rear elevation view of an apparatus according to one alternative embodiment of the invention, with a sign oriented at a maximum counterclockwise angulation.

FIG. 2 is a rear elevation view of an apparatus 200 according to one alternative embodiment of the invention, with a sign 202 oriented at a maximum counterclockwise angulation. The apparatus 200 may take the form of a billboard 200. The sign 202 is supported by a support member 204 in the form of a post 204. The post 204 is anchored to a supporting surface 206, which may be the ground. The billboard 200 has a repositioning mechanism 208 that varies the orientation of the sign 202 between maximum clockwise and counterclockwise angulations.

If desired, the repositioning mechanism 208 may be designed for easy retrofitting to existing billboards. Thus, conventional (e.g., non-rotating) billboards may be modified to rotate without the need to install a new sign 202 and/or post 204.

As shown, the sign 202 may have a sign surface 209. The side of the sign surface 209 visible in FIG. 2 is the back side; accordingly, the desired message may be displayed on the opposite side through a variety of methods known in the art. The sign surface 209 may be supported by horizontal angle irons 210 and vertical posts 212. The sign 202 also has a repositioning interface 213 that may take the form of a bracket or block attachable to an existing sign to retrofit it for rotation according to the invention.

The post 204 may have a proximal end 214 near the supporting surface 206, and a distal end 216 to which the sign 202 is coupled. The post 204 has a ladder 217 that facilitates access to the sign 202 (for the maintenance mentioned above) or to the repositioning mechanism 208 to permit maintenance or adjustment of the repositioning mechanism 208. The ladder 217 may terminate well above the supporting surface 206, or may have other features preventing access to the ladder 217 for all but authorized personnel.

The repositioning mechanism 208 may have a mounting bracket 218, a controller 220, a motion source 222, a transmission 224, a linkage 226, a disconnect mechanism 228, and a brake mechanism 230. As mentioned previously, the repositioning mechanism 208 may be designed for easy retrofit to existing billboards. Thus, the various components 220, 222, 224, 226, 228, 230 may be coupled to the mounting bracket 218, which, in turn, may be anchored to the post 204. A variety of attachment methods including adhesives, mechanical fasteners, and the like may be used to secure the mounting bracket 218 to the post 204.

The mounting bracket 218 may have a base member 240 that extends generally vertically along the side of the post 204 as shown. The mounting bracket 218 may also have a first flange 242 that extends forward of the post 204 (i.e., generally between the post 204 and the sign 202), and second and third flanges that extend rearward of the post 204. The flanges 242, 244, 246 may facilitate attachment of the mounting bracket 218 to the post 204, and may also serve to support the sign 202, brake mechanism 230, and the disconnect mechanism 228, respectively. The first flange 242 may support the sign 202 via a shaft 248 that permits relative rotation between the sign 202 and the post 204. The mounting bracket 218 may also have a transmission support 250 in the form of a cantilevered post 250 that supports the transmission 224.

The controller 220 may be coupled to the motion source 222. The motion source 222 may take the form of a motor 222, which may be an electric motor. Thus, the controller 220 may be connected to the motor 222 via wires 252. The controller 220 may simply be a power source such as a transformer or other circuitry designed to connect the motor 222 to public power, if available. If public power is not available, the controller 220 may include a battery or connection to a fuel-powered generator, solar cells, wind-driven generators, or other power generation equipment.

The controller 220 may deliver constant power to the motor 222, or may vary the power supply according to a predetermined pattern or time table. For example, the controller 220 may supply power to the motor 222 during the daytime when the sign 202 is likely to be seen, but not at night when viewing is less likely. Alternatively, the controller 220 may have sensors that control operation of the motor 222 based on factors such as wind speed, ambient light, road traffic, etc. Additionally or in the alternative, the controller 220 may receive user commands so that the user can select the operating parameters of the motor 222, either on-site or remotely. Long-distance wired connections or wireless links may be used to facilitate remote monitoring and/or control.

The motor 222 has a shaft 224 that rotates to deliver torque to the transmission 224. The transmission 224 receives torque from the motor 222 and converts it into a motion and force suitable for raising and lowering one side of the sign 202 to provide motion from one terminal orientation to the other, and back again. As embodied in FIG. 2, the transmission 224 has a pinion 260 and a gear 262 that are coupled together in rotation via teeth 264. The pinion is secured to the shaft 224 of the motor and the gear 262 is connected to the cantilevered post 250 via a shaft 266 that permits rotation of the gear 262 relative to the cantilevered post 250. The pinion 260 is much smaller than the gear 262, and therefore, the gear 262 will rotate much more slowly than the pinion 260, but with much greater torque.

The linkage 226 connects the transmission 224 to the sign 202. More specifically, the linkage 226 may have an arm 270 that is rotatably coupled to the gear 262 via a shaft 272 that is located toward the periphery of the gear 262. Thus, when the gear 262 rotates, the end of the arm 270 that is coupled to the gear 262 moves in a circular pattern. The other end of the arm 270 is rotatably coupled to the repositioning interface 213 of the sign 202. As the bottom end of the arm 270 moves in its circular pattern, the top end is driven upward and downward, thereby driving the right side of the sign 202 upward and downward to provide the desired rotation.

More precisely, when the shaft 272 is at the bottom of its circular motion, the sign 202 may be tilted at a maximum counterclockwise angulation, as shown in FIG. 2. When the shaft 272 is at the top of its circular motion, the sign 202 may be tilted at its maximum counterclockwise angulation. When the shaft 272 is horizontally aligned with the shaft 266 of the gear 262, the sign 202 may be substantially horizontal.

In order to enable rotation of the sign 202 independently of the transmission 224, it may be desirable to provide a way to de-couple the sign 202 from the transmission 224. The disconnect mechanism 228 may accomplish this function. The disconnect mechanism 228 has a lever arm 280 rotatably coupled to the third flange 246 via a shaft 282. The lever arm 280 is secured to the motor 222 so that, when the proximal end of the lever arm 280 (e.g., the end of the lever arm 280 proximate the latter 212) is pulled upward, the motor 222 and the pinion 260 are pulled away from the gear 262 such that the teeth 264 of the pinion 260 disengage from the teeth 264 of the gear 262.

The disconnect mechanism 228 may have a latch 284 that pivots or otherwise moves to keep the lever arm 280 positioned as shown in FIG. 2, to maintain rotational coupling between the pinion 260 and the gear 262 until disconnection is desired. The latch 284 may take the form of a pivotable shoe that holds the proximal end of the lever arm 280 down until it is moved by a user. The latch 284 may be lockable if desired to prevent tampering.

It may also be desirable to lock the sign 202 to prevent undesired rotation, particularly when the sign 202 is being serviced. Accordingly, the brake mechanism 230 may be designed to lock the sign 202 against further rotation. As embodied in FIG. 2, the brake mechanism 230 locks the sign 202 against rotation by locking the gear 262. More precisely, the brake mechanism 230 may include a lever arm 290 with a gear interface 292 at its distal end (i.e., the end furthest from the ladder 217). As the lever arm 290 rotates, the gear interface 292 can move into engagement with the teeth 264 of the gear 262 to prevent the gear 262 from rotating.

The brake mechanism 230 may have a latch 296 that pivots or otherwise moves to keep the lever arm 290 positioned as shown in FIG. 2, to allow the gear 262 to rotate until locking is desired. Like the latch 284, the latch 296 may take the form of a pivotable shoe that holds the proximal end of the lever arm 280 down until it is moved by a user. The latch 296 may also be lockable if desired to prevent tampering.

Figure 3:
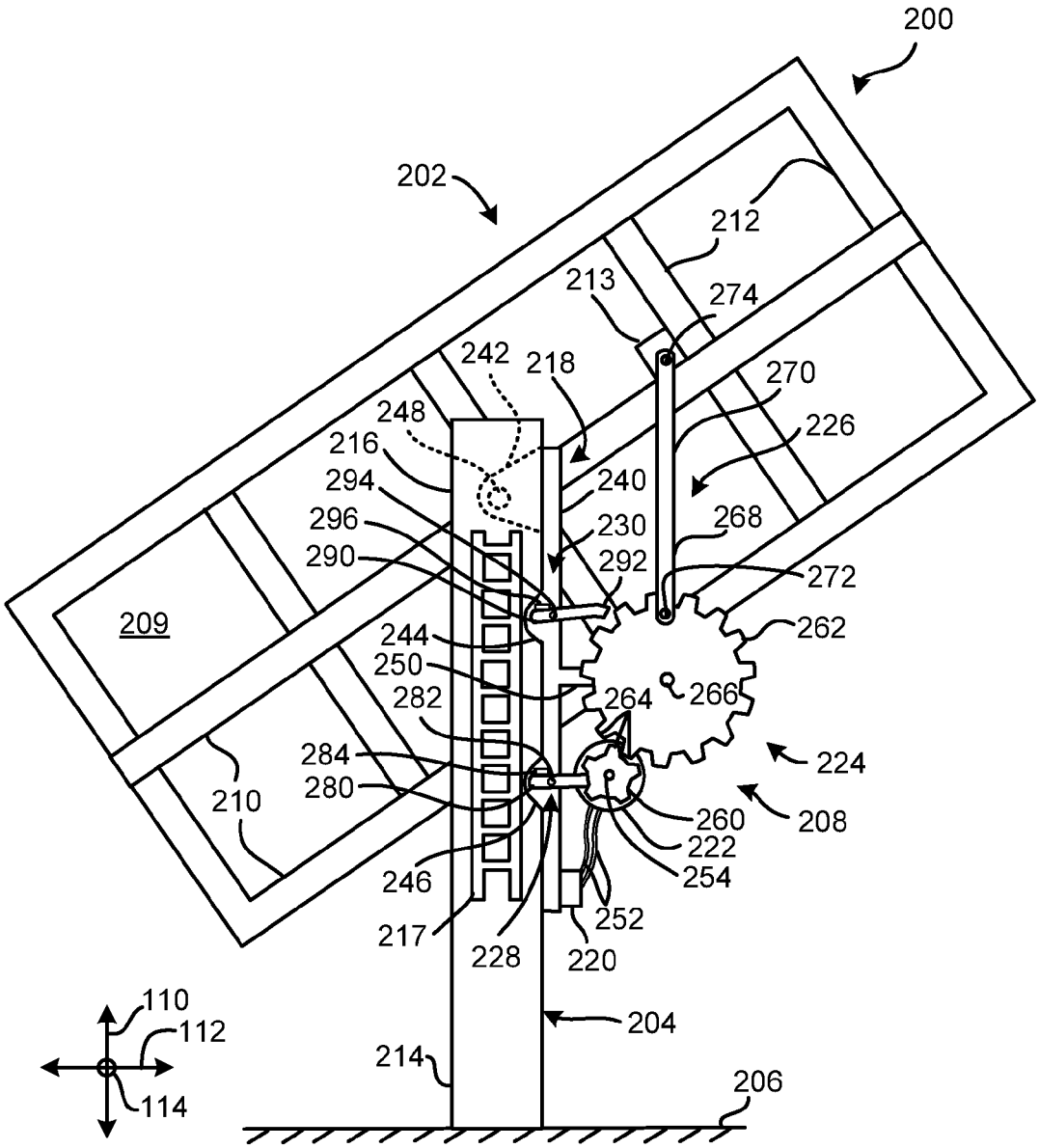
FIG. 3 is a rear elevation view of the apparatus of FIG. 2 with the sign oriented at a maximum clockwise angulation.

FIG. 3 is a rear elevation view of the apparatus 200 of FIG. 2 with the sign 202 oriented at a maximum clockwise angulation. As shown, the gear 262 has been rotated such that the shaft 272, and thence the repositioning interface 213, is at its highest possible position. The gear 262 may rotate clockwise or counterclockwise; the motion of the sign 262 will be similar.

Figure 4:
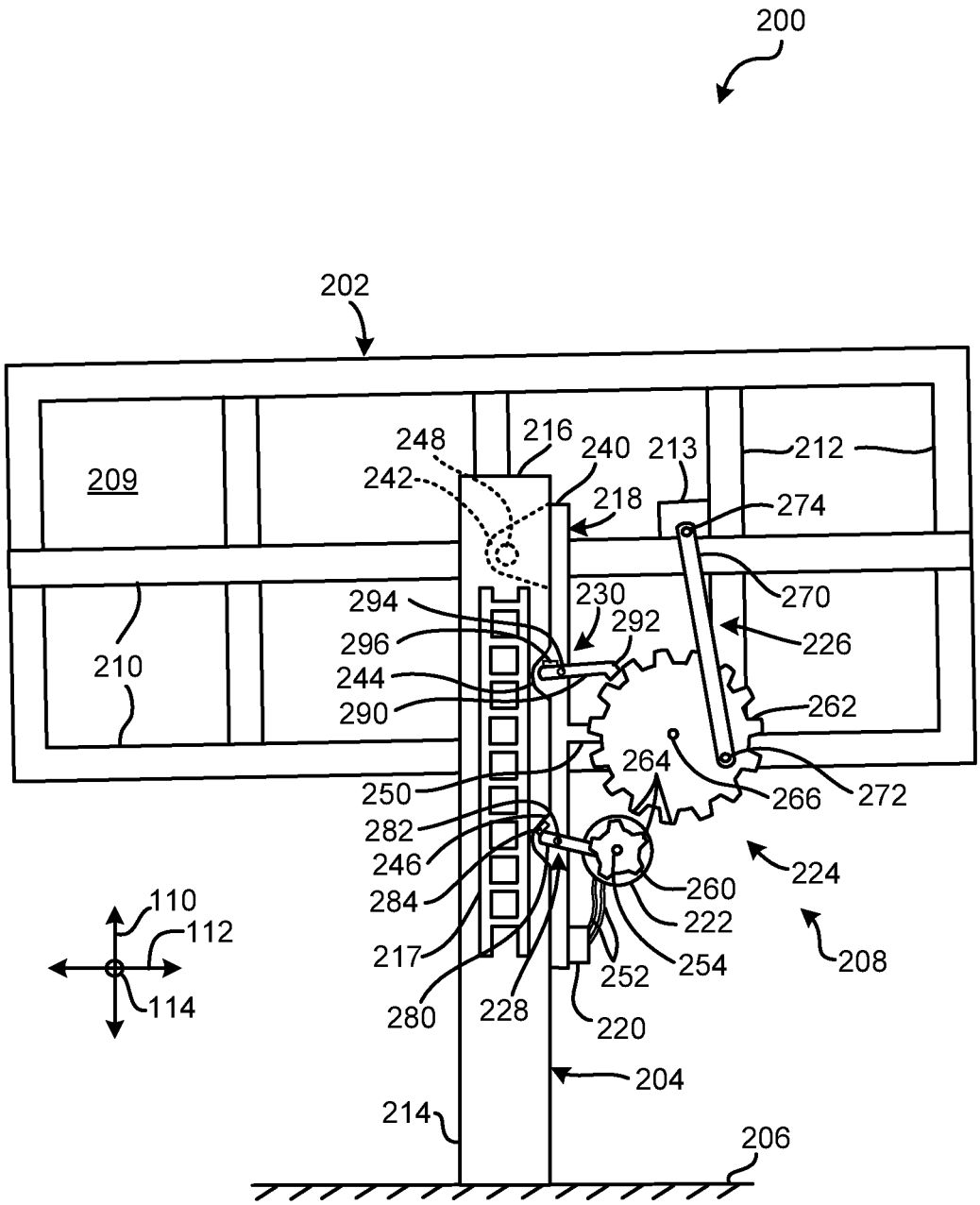
FIG. 4 is a rear elevation view of the apparatus of FIG. 2 with the transmission disengaged to allow the sign to return to a horizontal position as shown.

FIG. 4 is a rear elevation view of the apparatus 200 of FIG. 2 with the transmission 224 disengaged to allow the sign 202 to return to a horizontal position, as shown. More precisely, the latch 284 has been released and the lever arm 280 of the disconnect mechanism 228 has been shifted such that its proximal end is raised. Consequently, the motor 222 and the pinion 260 have been lowered so that the teeth 264 of the pinion 260 no longer engage the teeth 264 of the gear 262. The brake mechanism 230 has not been actuated, so the gear 262 is free to rotate until the sign 202 reaches its natural resting position.

It may be desirable to make sure this natural resting position is substantially horizontal so that, when disconnected from the motor 222 and pinion 260, the sign 202 naturally returns to an orientation suitable for maintenance. This may be accomplished in a variety of ways. If desired, the shaft 248 may be coupled to the sign 202 slightly above its center of gravity. Thus, the weight of the sign 202 (likely about three tons) may naturally swing it to its horizontal orientation. In the alternative, biasing members such as springs or gas cylinders may be used to accomplish this.

With the sign 202 in the horizontal orientation, it is ready for servicing, except that it would be beneficial to keep the sign 202 horizontal while the servicing takes place. In some embodiments, the weight of the sign 202 and/or the force exerted by the biasing members may be sufficient to accomplish this. However, it would be advantageous to make the sign 202 easy to rotate so as to minimize the power the motor 222 has to exert to accomplish the rotation. Thus, the brake mechanism 230 may be desirable.

Figure 5:
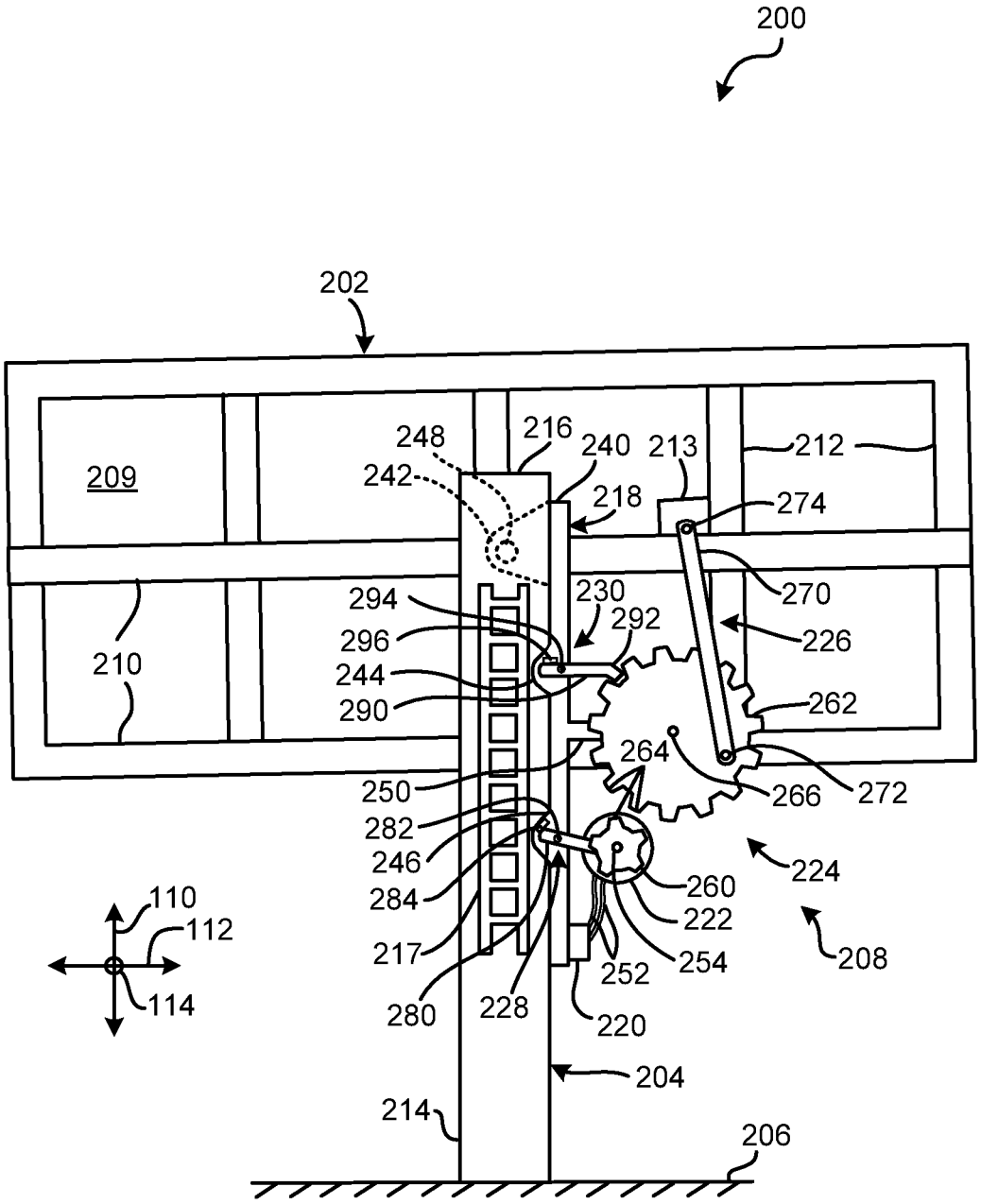
FIG. 5 is a rear elevation view of the apparatus of FIG. 2 with the transmission disengaged and the brake engaged to keep the sign at the horizontal position.

FIG. 5 is a rear elevation view of the apparatus 200 of FIG. 2 with the transmission 224 disengaged and the brake mechanism 230 engaged to keep the sign 202 at the horizontal orientation. More precisely, the latch 296 has been released and the lever arm 290 of the brake mechanism 230 has been shifted such that its proximal end is raised. Consequently, the gear interface 292 has been lowered into engagement with the teeth 264 of the gear 262 so that the gear 262 is no longer able to freely rotate. The sign 202 may now be safe for servicing.

Advantageously, the disconnect mechanism 228 and the brake mechanism 230 can be actuated by a user standing on the ladder 217. Thus, the sign 202 can be easily serviced. The person maintaining the sign 202 may (1) actuate the controller 220 to turn off the motor 222, (2) unlatch and shift the lever arm 280 to permit the sign 202 to return to the horizontal orientation, and then (3) unlatch and shift the lever arm 290 to prevent further rotation of the sign 202 until maintenance has been completed. These steps may all be carried out in the proper order set forth above, as the person ascends the ladder 217.

Maintenance of the billboard may include other tasks to maintain the repositioning mechanism 208. Such tasks may include lubricating the moving components, adjusting the programming of the controller 220 if it is programmable, or changing manual settings. If the repositioning mechanism 208 is powered by an exhaustible power supply such as batteries or a fuel-driven generator, the batteries and/or fuel may be replaced and/or recharged as needed. Part or all of the repositioning mechanism 208 may ordinarily be covered to protect its components from the weather or from the view of those passing by.

One benefit of the design of the billboard 202 is that the motor 222 need not be made to operate with variable speeds or different directions. Rather, the motor 222 may simply have an on-off state; the transmission 224 and the linkage 226 transform the simple rotational motion of the motor 222 to the desired cyclical motion of the sign 202. However, as mentioned previously, the motor 222 may instead be designed for more complex operations, and may change speeds or directions of rotation if desired. With such a motor, the linkage 226 could be omitted in favor of coupling a gear like the gear 262 directly to the shaft 248. A pinion like the pinion 260 could still be used and could be connected to such a motor; the motor could then reverse directions periodically to obtain the same motion as the repositioning mechanism 208 provides.

Many other modifications could be made to the billboard 200 within the scope of the invention. More precisely, a wide variety of brake mechanisms exist, including gripping brake pads, pins insertable through alignable holes to lock out motion, braces temporarily securable to billboard structures (for example, between the bottom of the sign 202 and the ground) to prevent motion, or the like. Any of these or other mechanisms known in the art for locking out motion could be used in place of the brake mechanism 230 if desired.

Furthermore, a wide variety of disconnect mechanisms could also be used in place of the disconnect mechanism 228. Levers, linear actuators, pulley systems, or any other known device may be used to decouple the motor 222 (or other motion source) from the sign 202. Alternatively, if the motor 222 has the proper characteristics, the disconnect mechanism 228 may simply be omitted. More precisely, if the motor 222 can be powered down such that it will spin relatively freely, the transmission 224 could remain fully connected while the sign 202 returns to the horizontal orientation.

A wide variety of transmissions and linkage devices exist; the transmission 224 and/or the linkage 226 could be replaced with any of a variety of mechanisms that could provide the desired motion profile of the sign 202. These mechanisms include, but are not limited to, gears (including worm gears and orthogonal gears), linkages, cams, and the like.

If the proper motor characteristics can be achieved, a transmission 224 may not even be needed; a motor or other motion source may simply directly provide the motion and force needed to move a sign in the desired manner. The motor 222 could be replaced with a wide variety of devices including gas-powered motors, wind-powered motors, hand-actuated devices such as hand-cranks, hydraulic actuators, and pneumatic actuators. Some of these devices, particularly those which are hand-operated, may require the presence of a user to effect the in-plane rotation of the sign. Thus, the sign may be adjusted only periodically, for example, once every few days or weeks, to gather fresh attention.

According to one alternative embodiment (not shown), in-plane rotation of a sign may be powered by the force of the wind on the sign. More specifically, such a billboard may have a mechanism that causes the sign to rotate in-plane when the sign rotates about the vertical axis 110 or about the lateral axis 112 in response to pressure of the wind.

Figure 6:
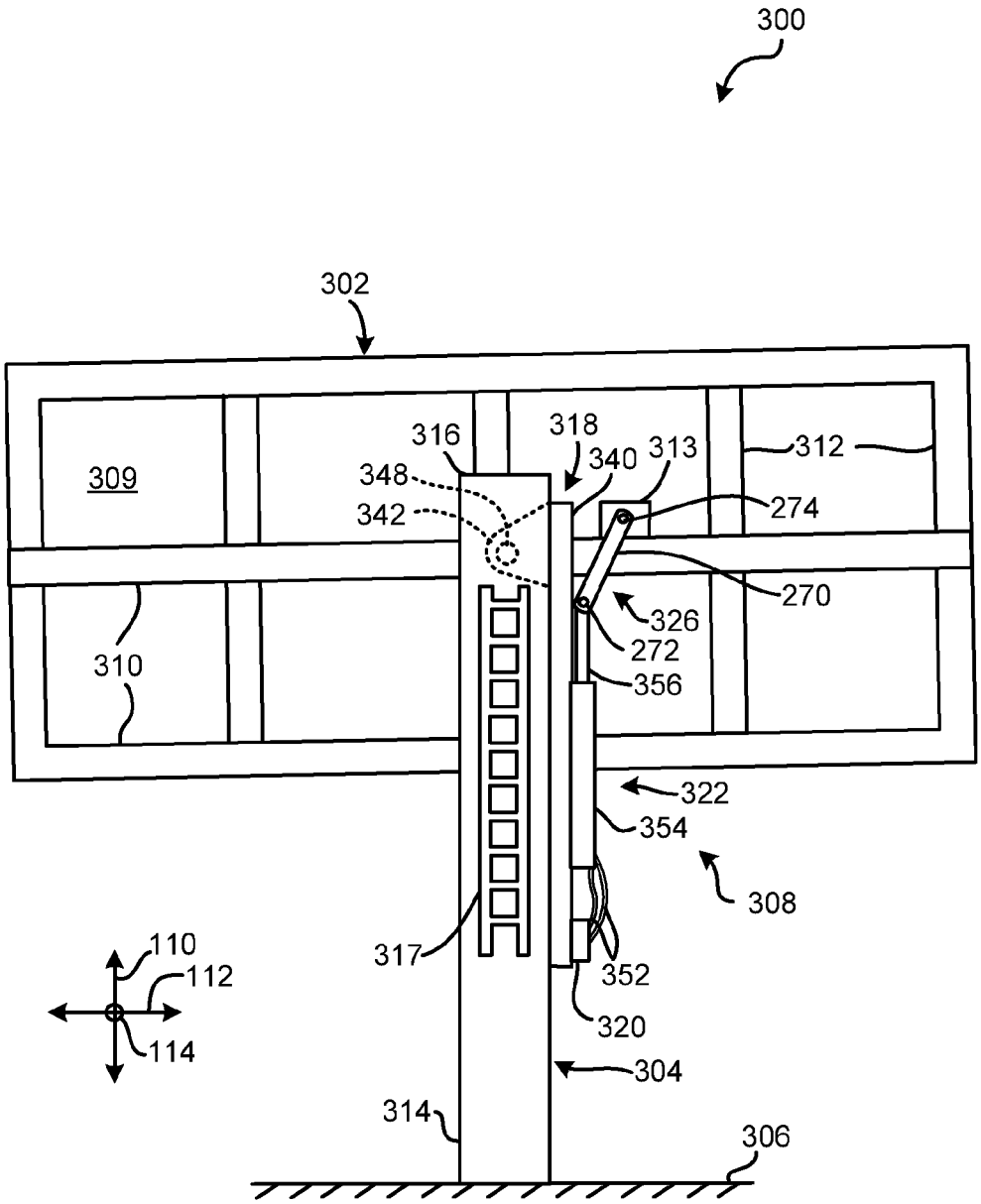
FIG. 6 is a rear elevation view of an apparatus according to another alternative embodiment of the invention.

FIG. 6 is a rear elevation view of an apparatus 300 according to another alternative embodiment of the invention. The apparatus 300 may take the form of a billboard 300. As with the billboard 200, the billboard 300 may have a sign 302 rotatably coupled to a support member 304, which may take the form of a post 304. The post 304 may support the sign 302 over a supporting surface 306 such as the ground.

The billboard 300 also includes a repositioning mechanism 308 that rotates the sign 302 in-plane, e.g., with respect to the transverse axis 114. The repositioning mechanism is configured differently from the repositioning mechanism 208 of the billboard 200, as will be described subsequently. However, like the repositioning mechanism 208, the repositioning mechanism 308 may be designed to be easily retrofitted to an existing conventional billboard.

Like the sign 202, the sign 302 may have a sign surface 309 supported by horizontal angle irons 310 and vertical posts 312. A repositioning interface 313 may be secured to the sign 302 to receive force from the repositioning mechanism 308 to rotate the sign 302. The post 304 may have a proximal end 314, a distal end 316, and a ladder 317 secured to the body of the post 304 to facilitate access for maintenance.

The repositioning mechanism 308 may have a mounting bracket 318, a controller 320, a motion source 322, and a linkage 326. As mentioned previously, the repositioning mechanism 308 may be designed for easy retrofit to existing billboards. Thus, the various components 320, 322, 326 may be coupled to the mounting bracket 318, which, in turn, may be anchored to the post 304. A variety of attachment methods including adhesives, mechanical fasteners, and the like may be used to secure the mounting bracket 318 to the post 304.

The mounting bracket 318 may have a base member 340 that extends generally vertically along the side of the post 304 as shown. The mounting bracket 318 may also have a first flange 342 that extends forward of the post 204 (i.e., generally between the post 204 and the sign 202). The flange 342 may facilitate attachment of the mounting bracket 318 to the post 304, and may also serve to support the sign 302 via a shaft 348 that permits relative rotation between the sign 302 and the post 304.

The controller 320 may be coupled to the motion source 322, which may take the form of a hydraulic ram 322. Thus, the controller 320 may be connected to the hydraulic ram 322 via hydraulic fluid lines 352. The controller 220 may include components such as a control board or computer and a hydraulic pump that pressurizes the fluid in the lines 352 and thence, in the hydraulic ram 322. As with the controller 222, the controller 322 may be connected to public power, a battery, or other power sources.

The hydraulic ram 322 may have a cylinder 354 that contains the hydraulic fluid and a shaft 356 driven by the pressure of the fluid via a piston (not shown) at the end of the shaft 356 within the cylinder 354. The exposed end of the shaft 356 may be rotatably coupled to an arm 370 of the linkage 326 via a shaft 372. The opposite end of the arm 370 may be rotatably coupled to the repositioning interface 313 via another shaft 374.

Beneficially, the repositioning mechanism 308 may operate independently of a transmission, disconnect mechanism, or brake mechanism—the use of the hydraulic ram 322 may obviate these elements. Instead, the shaft 356 pushes upward to move the arm 370, and thence the repositioning interface 313, upward, thereby rotating the sign 302. The hydraulic ram 322 may move with relatively low speed and high force; hence, there may be no need to "gear down" its output.

When it is time to service the sign 302, the controller 320 may be used to position the hydraulic ram 322 such that the sign 302 is oriented horizontally, as shown in FIG. 6. The pressure of the fluid within the cylinder 354 may then keep the shaft 356 in place. Thus, there may be no need to decouple the hydraulic ram 322 from the sign 302, and no need to lock the sign 302 in place independently of the operation of the hydraulic ram 322.

Maintenance of the billboard 300 may thus be accomplished by actuating the controller 320 to position the sign 302 in the horizontal orientation, then ascending the ladder 317 to perform the necessary tasks. Like the motor 220, the hydraulic ram 320 may be controlled with remote controls, on-site controls, or programming based on times or sensory inputs. Care of the billboard 300 may also include maintenance of the repositioning mechanism 308. If the controller 320 is not programmable, the user may simply use the controller 320 to manually set the orientation of the sign 302.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

The present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A sign repositioning apparatus comprising:

a power source providing power to the apparatus, wherein the power source is attachable to a support member;

a linkage attachable to a sign;

a transmission for transferring rotational power to the sign, wherein the transmission is interconnected between the power source and the linkage;

a disconnect mechanism for disconnecting at least one of 1) the transmission from one or both of the power source and the linkage and 2) the linkage from one or both of the transmission and the sign; and a brake mechanism for securing the sign in a specific position.

2. The apparatus of claim 1, wherein the transmission comprises a pinion and gear assembly.

3. The apparatus of claim 1, wherein the apparatus is retrofittable on an existing support member and an existing sign.

* * * * *